US009153177B2

(12) United States Patent
Hong et al.

(10) Patent No.: US 9,153,177 B2
(45) Date of Patent: Oct. 6, 2015

(54) APPARATUS FOR GENERATING GRAY SCALE VOLTAGE IN ORGANIC LIGHT EMITTING DISPLAY DEVICE

(71) Applicant: Samsung Display Co., Ltd., Yongin, Gyeonggi-do (KR)

(72) Inventors: Seung-Kyun Hong, Yongin (KR); So-Young Park, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 217 days.

(21) Appl. No.: 13/829,911

(22) Filed: Mar. 14, 2013

(65) Prior Publication Data

US 2014/0125567 A1 May 8, 2014

(30) Foreign Application Priority Data

Nov. 7, 2012 (KR) ..... 10-2012-0125482

(51) Int. Cl.
*G09G 5/10* (2006.01)
*G09G 3/32* (2006.01)

(52) U.S. Cl.
CPC ..... *G09G 3/3291* (2013.01); *G09G 2320/0242* (2013.01); *G09G 2320/0276* (2013.01); *G09G 2320/0673* (2013.01); *G09G 2330/028* (2013.01)

(58) Field of Classification Search
CPC ..... G09G 3/3291; G09G 2330/028; G09G 2320/0673; G09G 2320/0242; G09G 2320/0276
USPC ..... 345/82, 83, 87–89, 204, 690
See application file for complete search history.

(56) References Cited

U.S. PATENT DOCUMENTS

| | | | | |
|---|---|---|---|---|
| 5,854,627 | A * | 12/1998 | Kurihara et al. | 345/211 |
| 9,019,321 | B2 * | 4/2015 | Lee | 345/690 |
| 2002/0186230 | A1 * | 12/2002 | Kudo et al. | 345/690 |
| 2007/0047033 | A1 | 3/2007 | Furui | |
| 2008/0186264 | A1 * | 8/2008 | Lee | 345/82 |
| 2009/0009453 | A1 * | 1/2009 | Furihata et al. | 345/87 |
| 2010/0039455 | A1 | 2/2010 | Ahn | |
| 2010/0123653 | A1 * | 5/2010 | Kwon et al. | 345/89 |
| 2011/0234644 | A1 | 9/2011 | Park et al. | |
| 2013/0265344 | A1 * | 10/2013 | Taniguchi | 345/690 |

FOREIGN PATENT DOCUMENTS

| | | | |
|---|---|---|---|
| KR | 10-2007-0024364 | A | 3/2007 |
| KR | 10-2008-0088701 | A | 10/2008 |
| KR | 10-2010-0021356 | A | 2/2010 |
| KR | 10-1065406 | B1 | 9/2011 |

* cited by examiner

*Primary Examiner* — Rodney Amadiz
(74) *Attorney, Agent, or Firm* — Knobbe, Martens, Olson & Bear, LLP

(57) ABSTRACT

An apparatus for generating a gray scale voltage in an organic light emitting display device is disclosed. In one aspect, the apparatus includes a gamma reference voltage generator, a gray scale voltage output unit and a gray scale voltage selector. The gamma reference voltage generator outputs a gamma reference voltage. The gray scale voltage output unit outputs N first gray scale voltages, based on the gamma reference voltage. The gray scale voltage selector has a lookup table in which voltage values respectively corresponding M reference gray scales are previously set, and outputs second gray scale voltages by selecting M of the N first gray scale voltages.

9 Claims, 5 Drawing Sheets

FIG. 5

| Input gray scale(Vi_n) | Voltage value | Output gray scale(Vo_m) | Voltage value |
|---|---|---|---|
| Vi_0 | 0.00 | Vo_0 | 0.00 |
| Vi_1 | 0.03 | Vo_1 | 0.03 |
| Vi_2 | 0.07 | Vo_2 | 0.07 |
| Vi_3 | 0.10 | Vo_3 | 0.10 |
| Vi_4 | 0.13 | Vo_4 | 0.13 |
| Vi_5 | 0.17 | Vo_5 | 0.20 |
| Vi_6 | 0.20 | Vo_6 | 0.27 |
| Vi_7 | 0.23 | Vo_7 | 0.40 |
| Vi_8 | 0.27 | Vo_8 | 0.60 |
| Vi_9 | 0.30 | Vo_9 | 0.77 |
| Vi_10 | 0.33 | Vo_10 | 0.83 |
| Vi_11 | 0.37 | Vo_11 | 0.87 |
| Vi_12 | 0.40 | Vo_12 | 0.90 |
| Vi_13 | 0.43 | Vo_13 | 0.93 |
| Vi_14 | 0.47 | Vo_14 | 0.97 |
| Vi_15 | 0.50 | Vo_15 | 1.00 |
| Vi_16 | 0.53 | | |
| Vi_17 | 0.57 | | |
| Vi_18 | 0.60 | | |
| Vi_19 | 0.63 | | |
| Vi_20 | 0.67 | | |
| Vi_21 | 0.70 | | |
| Vi_22 | 0.73 | | |
| Vi_23 | 0.77 | | |
| Vi_24 | 0.80 | | |
| Vi_25 | 0.83 | | |
| Vi_26 | 0.87 | | |
| Vi_27 | 0.90 | | |
| Vi_28 | 0.93 | | |
| Vi_29 | 0.97 | | |
| Vi_30 | 1.00 | | |

APPARATUS FOR GENERATING GRAY SCALE VOLTAGE IN ORGANIC LIGHT EMITTING DISPLAY DEVICE

RELATED APPLICATIONS

This application claims priority to and the benefit of Korean Patent Application No. 10-2012-0125482, filed on Nov. 7, 2012, in the Korean Intellectual Property Office, the entire content of which is incorporated herein by reference.

BACKGROUND

1. Field

The described technology generally relates to an organic light emitting diode (OLED) display.

2. Description of the Related Technology

An OLED display is a kind of flat panel display which uses an organic compound as a light emitting material. The OLED device has excellent luminance and color purity, and is thin and light. In addition, the display has low power consumption. Thus, it is expected that OLED display technology will be widely used in various types of display devices including portable display devices.

In general, OLED displays control the difference between data voltages by adjusting voltage levels of gray scale voltages so as to display an image suitable for an OLED panel having unique gamma characteristics.

SUMMARY

One inventive aspect is an apparatus for generating a gray scale voltage in an organic light emitting display device, which can improve display quality.

Another aspect is an apparatus for generating a gray scale voltage in an organic light emitting display device, which can freely set gray scale voltages according to various characteristics of a display panel.

Another aspect is a touch screen panel, including: a gamma reference voltage generator outputting a gamma reference voltage; a gray scale voltage output unit outputting N first gray scale voltages, based on the gamma reference voltage; and a gray scale voltage selector having a lookup table in which voltage values respectively corresponding M reference gray scales are previously set, and outputting second gray scale voltages by selecting M of the N first gray scale voltages.

At least M of the first gray scale voltages may be input to the gray scale voltage selector, and the others may be bypassed and output.

2M of the first grays scale voltages may be input to the gray scale voltage selector, and the other (N−2M) first gray scale voltages may be bypassed and output.

The first gray scale voltages input to the gray scale voltage selector, the previously set reference gray scales and the second gray scale voltage may be ones in a low gray scale region.

The low gray scale region may include the minimum gray scale voltage among the first gray scale voltages.

The first gray scale voltages input to the gray scale voltage selector may have substantially equal voltage differences therebetween, and the second gray scale voltages may have unequal voltage differences therebetween.

The number of the reference gray scales and voltage values corresponding to the respective reference gray scales may be varied according to the setting of the lookup table.

The gamma reference voltage generator may generate a plurality of gamma reference voltages, and the gray scale voltage output unit may generate the first gray scale voltages by dividing voltages between the gamma reference voltages.

The N and M may be natural numbers, and the N may be greater than the M.

BRIEF DESCRIPTION OF THE DRAWINGS

FIG. 5 is a table illustrating embodiments of input and output gray scales shown in FIG. 4.

DETAILED DESCRIPTION

Figure 1:
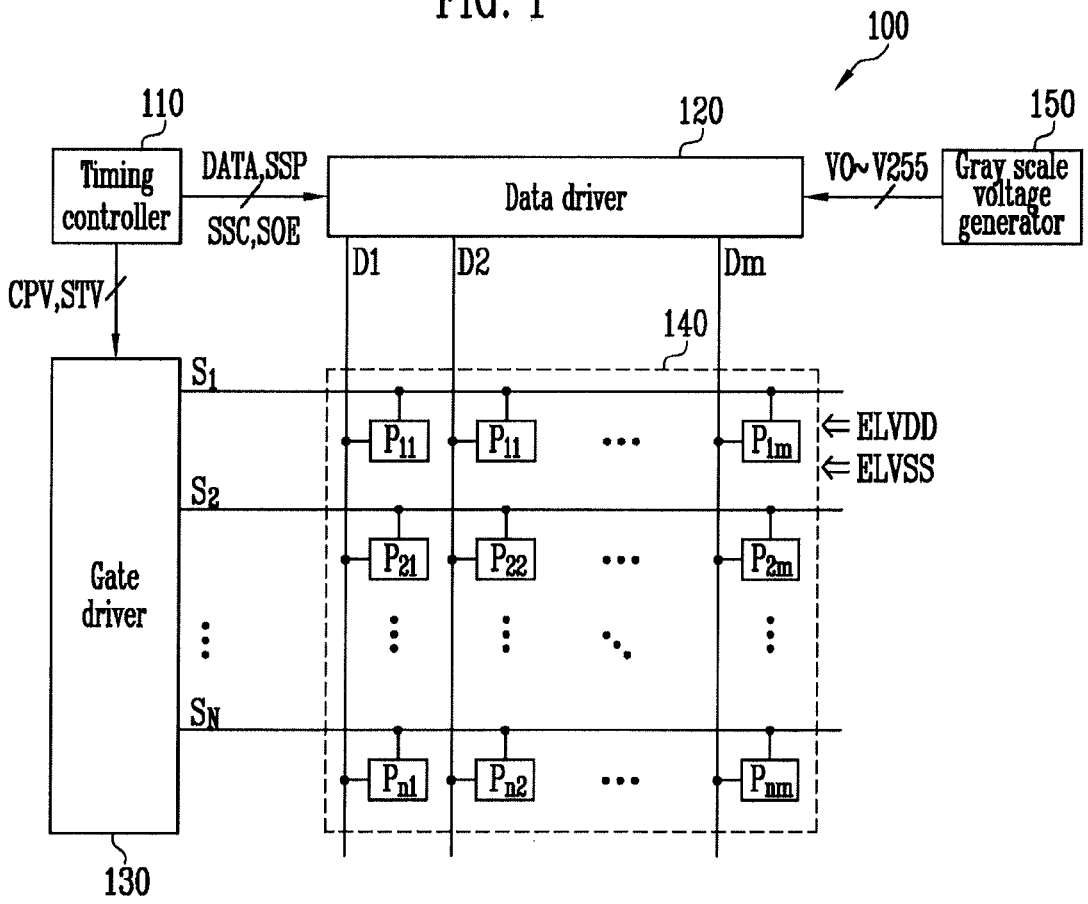
FIG. 1 is a block diagram illustrating the structure of an organic light emitting display device according to an embodiment.

Generally, an OLED display includes a gray scale voltage generator that generates gray scale voltages and controls the voltage level of each gray scale voltage. However, since there is a limitation in adjusting the voltage levels of gray scale voltages, the gray scale voltage generator cannot output appropriate gray scale voltages required in an OLED panel having the unique gamma characteristics.

Specifically, the gray scale voltage generator has a linear R-string structure in which gray scale voltages are generated with an equal difference therebetween. As the gray scale voltage generator with the linear R-string structure is combined with a driving TFT having exponential voltage-current characteristics, the gamma value is increased more than the target gamma value ($\gamma$=2.2), and colors of an image displayed by the organic light emitting display are distorted.

A non-linear R-string structure has been proposed so as to compensate for the voltage-current characteristics of the TFT. However, the non-linear R-string structure cannot correct even OLED voltage-current characteristics in which the emission efficiency is rapidly lowered in a low gray scale region.

Hereinafter, certain exemplary embodiments will be described with reference to the accompanying drawings. Here, when a first element is described as being coupled to a second element, the first element may be not only directly coupled to the second element but may also be indirectly coupled to the second element via a third element. Also, like reference numerals refer to like elements throughout.

FIG. 1 is a block diagram illustrating the structure of an organic light emitting display device according to an embodiment.

Referring to FIG. 1, the organic light emitting display device 100 includes a timing controller 110 generating control signals and outputting the generated control signals to a data driver 120 and a gate driver 130. The data driver 120 outputs a data voltage corresponding to an input image to a plurality of pixels P11 to Pnm through data lines D1 to Dm. The gate driver 130 outputs scan signals to the pixels P11 to Pnm through scan lines S1 to Sn. The device 100 also includes a pixel unit 140 including the pixels P11 to Pnm coupled to the scan lines S1 to Sn and the data lines D1 to Dm. The device 100 further includes a gray scale voltage generator 150 generating a plurality of gray scale voltages V0 to V255 and supplying the generated gray scale voltages to the data driver 120.

Here, the gate driver 130 may perform an operation of outputting an emission control signal to a plurality of emission control lines (not shown) coupled to the pixels, as well as the scan lines.

The timing controller 110 receives an input image signal and an input control signal for controlling the display of the input image signal from an external graphic controller (not shown). The timing controller 110 generates an input image data DATA, a source start pulse SSP, a source shift clock SSC, a source output enable (SOE), etc., from the input image signal and the input control signal, and outputs them to the data driver 120. The timing controller 110 generates a gate driving clock CPV, a start pulse STV, etc., and outputs them the gate driver 130.

The pixel unit 140 has the pixels P11 to Pnm positioned at intersection portions of the scan lines S1 to Sn and the data lines D1 to Dm. The pixels P11 to Pnm may be arranged in an m*n matrix form as shown in FIG. 1. Each of the pixels P11 to Pnm includes a light emitting element, and receives high and low power voltages ELVDD and ELVSS for actuating the light emitting element (organic light emitting diode) from the outside. Each of the pixels P11 to Pnm allows the light emitting element to emit light with luminance corresponding to the data voltage by supplying driving current or voltage to the light emitting element.

Each of the pixels P11 to Pnm controls the amount of current supplied to the light emitting element, corresponding to a data voltage supplied through the data lines D1 to Dm, and the light emitting element emits light with luminance corresponding to the data voltage.

Figure 2:
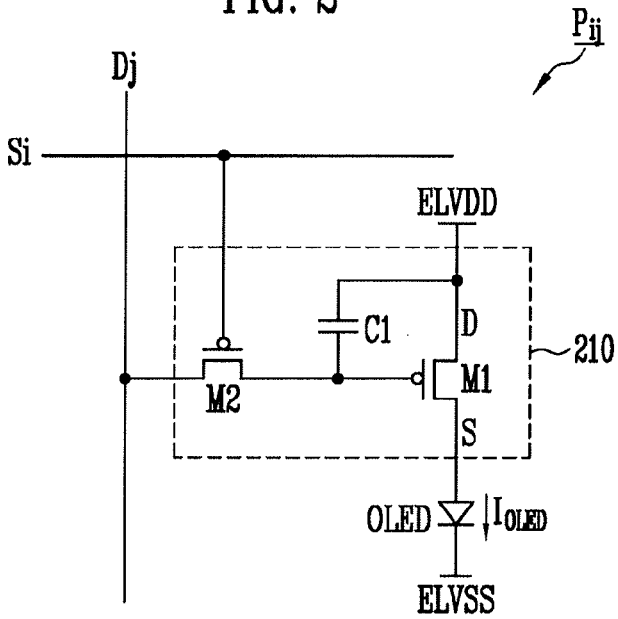
FIG. 2 is a circuit diagram illustrating the structure of an embodiment of a pixel shown in FIG. 1.

FIG. 2 is a circuit diagram illustrating the structure of an embodiment of a pixel Pij shown in FIG. 1.

The pixel provided in the organic light emitting display device is not limited to the embodiment of FIG. 2.

The pixel Pij according to this embodiment includes an OLED as a light emitting element and a pixel circuit 210. The OLED emits light by receiving driving current $I_{OLED}$ output from the pixel circuit 210. The luminance of the light emitted from the OLED is changed depending on the amplitude of the driving current $I_{OLED}$.

The pixel circuit 210 may include a capacitor C1, a driving transistor M1 and a switching transistor M2. The driving transistor M1 includes a first terminal D through which a high power voltage ELVDD is supplied to the driving transistor M1, a second terminal S coupled to an anode of the OLED, and a gate terminal coupled to a second terminal of the switching transistor M2. The anode of the OLED is coupled to the second terminal S of the driving transistor M1, and a cathode of the OLED is coupled to a low power voltage ELVSS.

The switching transistor M2 includes a first terminal coupled to a data line Dj, the second terminal coupled to the gate terminal of the driving transistor M1, and a gate terminal coupled to a scan line Si. The capacitor C1 is coupled between the gate terminal and first terminal D of the driving transistor M1.

If a scan signal having a gate-on level is supplied to the switching transistor M2 through the scan line Si, a data voltage is applied the gate terminal of the driving transistor M1 and a first terminal of the capacitor C1 through the switching transistor M2. While a valid data voltage is applied through the data line Dj, a voltage level corresponding to the data voltage is charged in the capacitor C1. The driving transistor M generates driving current $I_{OLED}$ according to the voltage level of the data voltage and outputs the generated driving current to the OLED.

The OLED receives the driving current $I_{OLED}$ input from the pixel circuit 210, so as to emit light with luminance corresponding to the data voltage.

The data driver 120 generates a data voltage using the input image data DATA, the source start pulse SSP, the source shift clock SSC and the source output enable SOE, which are input from the timing controller 110, and outputs the generated data voltage to the pixels P11 to Pnm through the data lines D1 to Dm. The data voltage may be output to a plurality pixels positioned on the same row during one horizontal period. Each of the data lines D1 to Dm through which the data voltage is applied to pixels P11 to Prim may be coupled to a plurality of pixels positioned on the same column.

Figure 3:
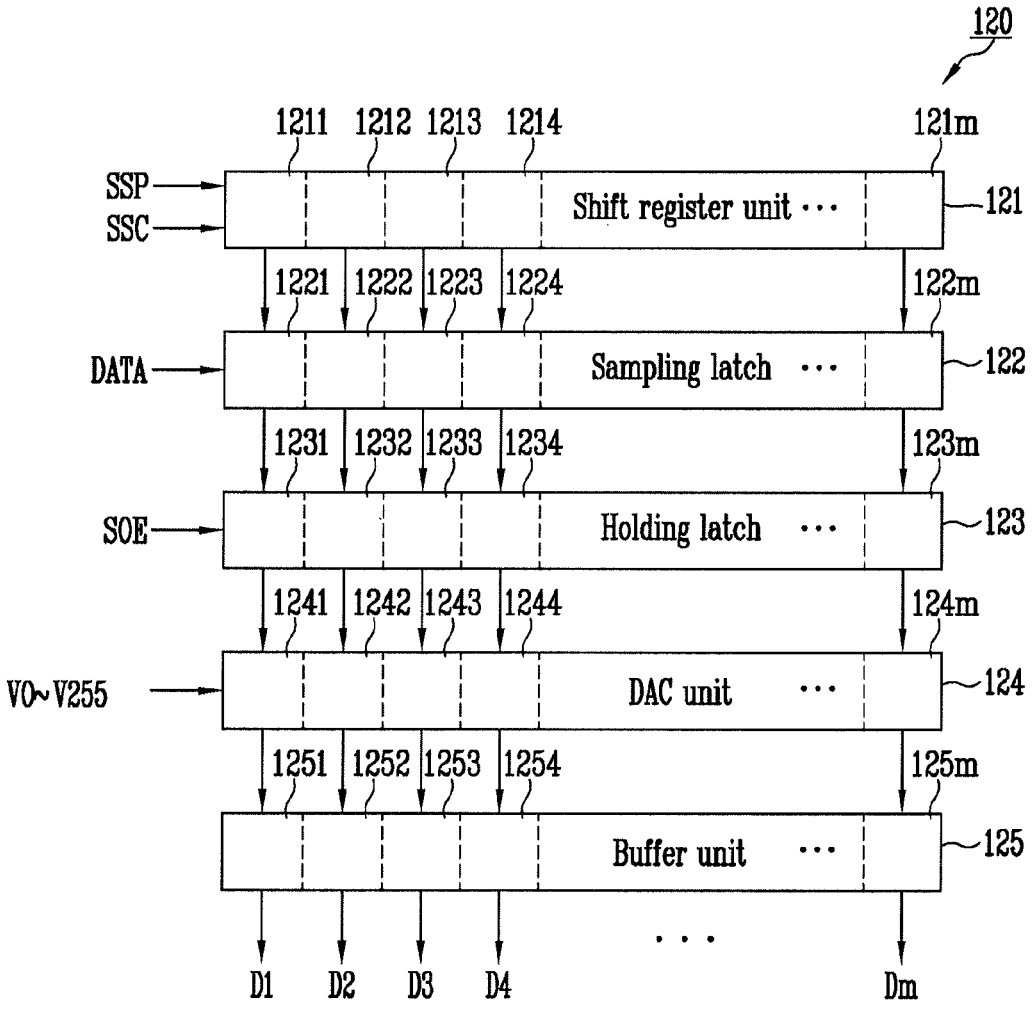
FIG. 3 is a view illustrating the structure of a data driver according to an embodiment.

FIG. 3 is a view illustrating the structure of a data driver according to an embodiment.

Referring to the data driver 120 includes a shift register unit 121, a sampling latch unit 122, a holding latch unit 123, a digital-analog converter (DAC) unit 124 and a buffer unit 125.

The shift register unit 121 receives a source start pulse SSP and a source shift clock SSC, supplied from the timing controller 110. The shift register unit 121 that has received the source shift clock SSC and the source start clock SSP progressively generates m sampling signals while shifting the source start pulse SSP every one period of the source shift clock SSC.

To this end, the shift register unit 121 has m shift registers 121*l* to 121*m*.

The sampling latch unit 122 progressively stores the input image data DATA in response to sampling signals progressively supplied from the shift register unit 121. To this end, the sampling latch unit 122 has m sampling latches 122*l* to 122*m* for storing m input image data DATA.

The holding latch unit 123 receives a source output enable SOE supplied from the timing controller 110. The holding latch unit 123 that has received the source output enable SOE receives input image data DATA input from the sampling latch unit 122 and stores the input image data DATA. The holding latch unit 123 supplies, to the DAC unit 124, the input image data DATA stored therein. To this end, the holding latch unit 123 has m holding latches 123*l* to 123*m*.

The DAC unit 124 receives input image data DATA input from the holding latch unit 123 and receives gray scale voltages V0 to V255 input from the gray scale generator 150, so as to generate m data voltages, corresponding the input image data DATA. To this end, the DAC unit 124 has m DACs 124*l* to 124*m*. That is, the DAC unit 124 generates m data voltages using DACs 124*l* to 124*m* respectively positioned in channels, and supplies the generated data voltages to the buffer unit 125.

The buffer unit 125 supplies the m data voltages supplied from the DAC unit 124 respectively to m data lines D1 to Dm. To this end, the buffer unit 125 has m buffers 125*l* to 125*m*.

The gate driver 130 generates a scan signal, using the gate driving pulse CPV, the start pulse STV, etc., input from the timing controller 110, and outputs the generated scan signal to each of the pixels P11 to Pnm through the scan lines S1 to Sn.

As described above, the gate driver 130 may output an emission control signal to each of the pixels P11 to Pnm through the emission control lines (not shown). That is, the scan lines Si to Sn and the emission control lines (not shown) may progressively or simultaneously output, for each row, scan signals and emission control signals, respectively. According to an embodiment, in the organic light emitting display device 100, the gate driver 130 may generate an additional driving signal and output the generated driving signal to each of the pixels P11 to Pnm.

The gray scale voltage generator 150 generates a plurality of gamma-corrected gray scale voltages V0 to V255, and outputs the generated gray scale voltages to the data driver 120. The number of the gray scale voltages V0 to V255 may be changed depending on the number of gray scales expressed in the organic light emitting display device 100. Although it has been described in this embodiment that the gray scales expressed in the organic light emitting display device 100 are 256 gray scales, the present invention is not necessarily limited thereto.

Figure 4:
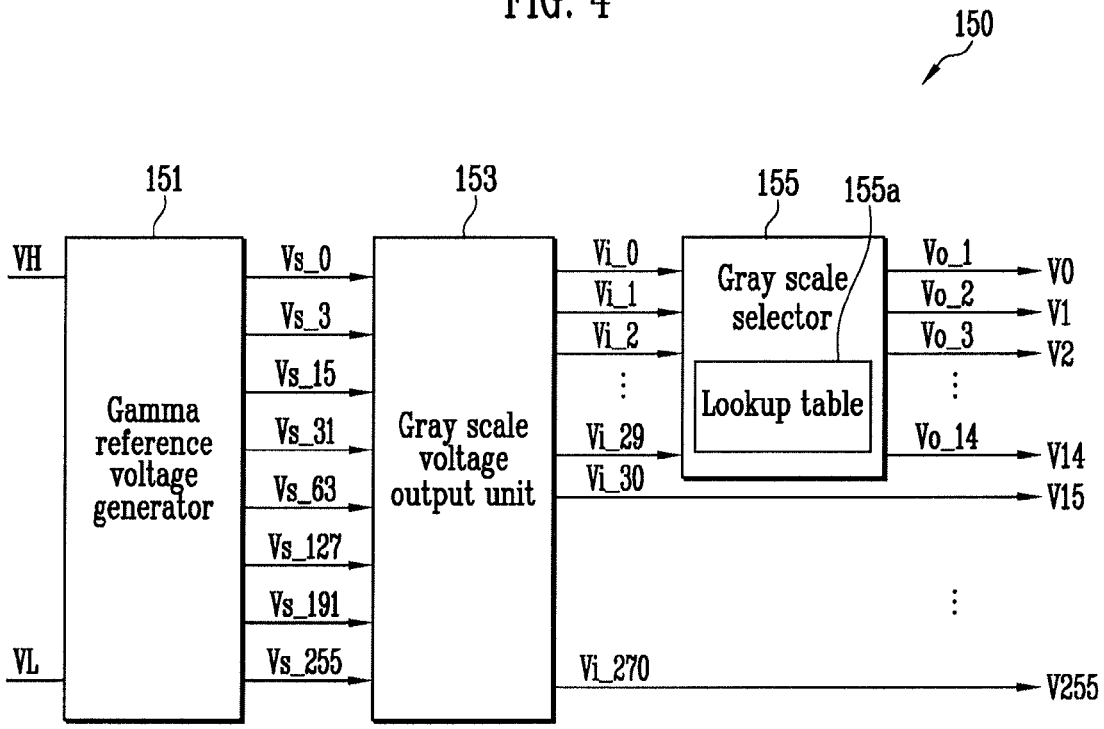
FIG. 4 is a block diagram schematically illustrating the configuration of a gray scale voltage generator according to an embodiment.

FIG. 4 is a block diagram schematically illustrating the configuration of a gray scale voltage generator according to an embodiment.

Referring to FIG. 4, the gray scale voltage generator 150 includes a gamma reference voltage generator 151, a gray scale voltage output unit 153 and a gray scale selector 155.

A lookup table 155*a* is included in the gray scale selector 155. Here, voltage values of gray scales for correction so that display quality is optimized according to characteristics of the organic light emitting display device are recorded in the lookup table 155*a*.

In an organic light emitting display device, there is a problem in that the luminance of a completed product may be expressed different from the target luminance, using the related art method of generating linear gray scale voltages, due to exponential voltage-current characteristics of the driving TFT and voltage-current characteristics in which the emission efficiency is rapidly lowered in a low gray scale region of the organic light emitting element.

The kind and arrangement structure of the driving TFT and organic light emitting element are slightly changed depending on each product of the organic light emitting display device, and hence a correction method cannot be identically applied to all the products of the organic light emitting display device.

Therefore, it is required to provide a function capable of freely setting gray scale voltages according to unique gamma characteristics of each product of the organic light emitting display device.

Accordingly, in this embodiment, voltage-current characteristics of the TFT and OLED panel can be simultaneously corrected by outputting gray scale voltages selected according to a predetermined lookup table. Particularly, gamma correction can be optimized in a low gray scale region.

Further, gray scale voltages can be freely set according to unique characteristics of various kinds of display panels, thereby improving display quality.

Hereinafter, the operation of the gray scale generator 150 will be described in detail.

The gamma reference voltage generator 151 determines the maximum reference voltage Vs_0 at which the minimum gray scale is displayed and the minimum reference voltage Vs_255 at which the maximum gray scale is displayed among voltage levels between the maximum and minimum power voltages VH and VL input from the outside of the gray scale voltage generator 150.

The gamma reference voltage generator 151 may generate intermediate reference voltages between the maximum reference voltage Vs_0 and the minimum reference voltage Vs_255.

For example, the gamma reference voltage generator 151 generates intermediate reference voltages Vs_3, Vs_15, Vs_31, Vs_63, Vs_127 and Vs_191 corresponding to inflection points at which slopes are changed on a gamma curve representing the relationship between gray scale levels and gamma corrected gray scale voltages respectively corresponding to the gray levels.

Here, the number of the intermediate reference voltages may be provided identically to that of inflection points on the gamma curve representing the optimal display characteristic of the display panel.

The gray scale voltage output unit 153 outputs N first gray scale voltages Vi_n, based on the gamma reference voltages determined by the gamma reference voltage generator 151.

The gray scale voltage output unit 153 may generate the first gray scale voltages by dividing voltages between the gamma reference voltages.

Here, at least M (here, M<N) of the first gray scale voltages Vi_n are input to the gray scale selector 151, and the others are bypassed and output to the data driver 120. Therefore, N as a total number of the first gray scale voltages Vi_n is greater than the number of final gray scale voltages V0 to V255 output to the data driver 120.

In an embodiment, the gray scale voltage output unit 153 may divide the voltages between the gamma reference voltages at a finer interval so as to output gray scale voltages of which number is greater than that of the final gray scale voltages V0 to V255.

In another embodiment, the gray scale voltage output unit 153 may divide the voltages between the gamma reference voltages at a finer interval within only the M gray scale voltages input to the gray scale voltage selector 155.

In this embodiment, 2M of the first gray scale voltages Vi_n are input to the gray scale voltages selector 155, and the other (N−2M) of the first gray scale voltages Vi_n are bypassed and output to the data driver 120.

For example, the number of the final gray scale voltages V0 to V255 is 256, and the number of the first gray scale voltages Vi_n is 270. 30 of the first gray scale voltages Vi_n are input to the gray scale voltage selector 155.

Here, the first gray scale voltages Vi_0 to Vi_29 input to the gray scale selector 155 are preferably one in a low gray scale region. The low gray scale region is a region including the minimum gray scale voltage Vi_0 among the first gray scale voltages Vi_n.

For example, the gray scale voltage output unit 153 receives gamma reference voltages input from the gamma reference voltage generator 151 and determines a plurality of voltage levels having a linear relationship within two reference voltage ranges as first gray scale voltages Vi_n, thereby outputting a total of 270 first gray scale voltages Vi_0 to Vi_270.

The first gray scale voltages Vi_0 to Vi_29 in the low gray scale region among the first gray scale voltages Vi_0 to Vi_270 are input to the gray scale voltage selector 155, and the other first gray scale voltages Vi_30 to Vi_270 are bypassed.

The gray scale voltage output unit 153 may be easily configured with a plurality of resistors (R-string) with the same resistance, coupled in series to one another, but the present invention is not limited thereto.

The gray scale voltage selector 155 includes the lookup table 155*a* in which voltage values corresponding to the respective M reference gray scales are previously set. The gray scale voltage selector 155 outputs second gray scale voltages Vo_m by selecting M of the first gray scale voltages Vi_n according to the lookup table 155*a*.

The number of reference gray scales previously set in the lookup table 155*a* and the voltage values corresponding to the respective reference gray scales may be varied according to the setting of the lookup table 155*a*.

Like the first gray scale voltages Vi_n input to the gray scale voltage selector 155, the predetermined reference gray scales and the second gray scale voltages Vo_m are preferably ones in the low gray scale region.

For example, voltage values for 30 gray scale voltages in the low gray scale region are previously set in the lookup table 155*a*, and 30 first gray scale voltages Vi_0 to Vi_29 in the low gray scale region among the total of 270 first gray scale voltages Vi_0 to Vi_270 are input to the gray scale voltage selector 155. Thus, gray scale voltages having specific voltage values are selected according to the setting of the lookup table 155*a*, thereby outputting 15 second gray scale voltages Vo_1 to Vo_14.

Here, the other first gray scale voltages Vi_30 to Vi_270 except the first gray scale voltages Vi_0 to Vi_29 in the low gray scale region are bypassed.

Finally, the second gray scale voltages Vo_1 to Vo_14 output from the gray scale voltage selector 155 become first to fourteenth final gray scale voltages V0 to V14 in the low gray scale region among the final gray scale voltages output to the data driver 120, and the bypassed first gray scale voltages Vi_30 to Vi_270 become fifteenth to 255-th final gray scale voltages V15 to V255.

Figure 6:
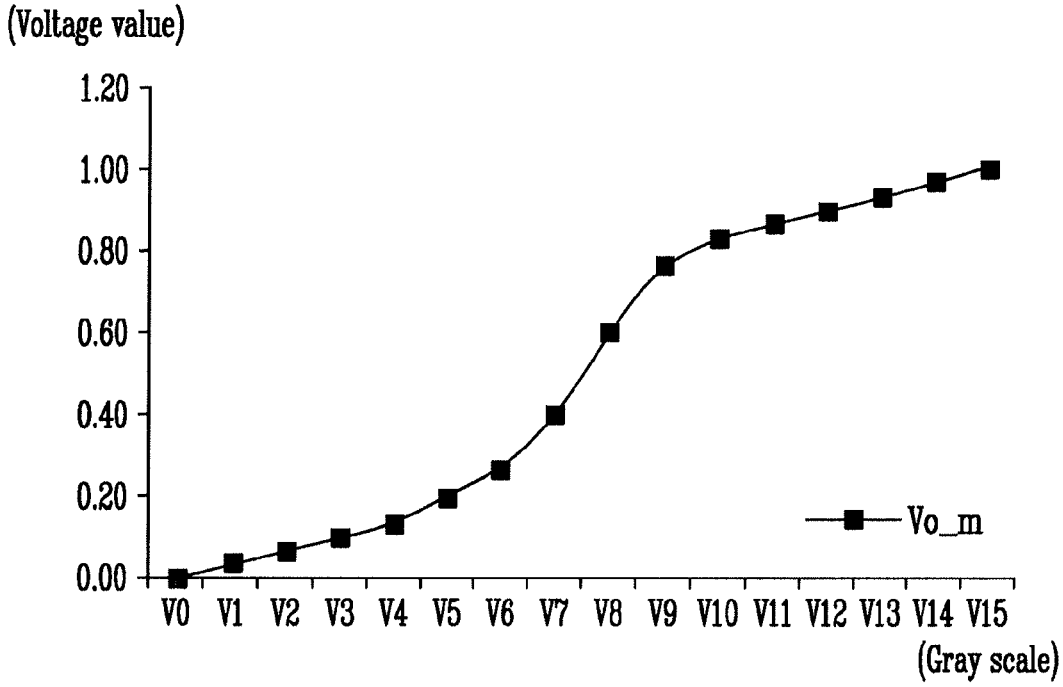
FIG. 6 is a graph illustrating gray scale-voltage characteristics of the output gray scales shown in FIG. 5.

FIG. 5 is a table illustrating embodiments of input and output gray scales Vi_n and Vo_m shown in FIG. 4. FIG. 6 is a graph illustrating gray scale-voltage characteristics of the output gray scales Vo_m shown in FIG. 5.

Here, the numbers and voltage values of the input and output gray scale voltages shown in FIGS. 5 and 6 are provided for illustrative purposes, and the setting of the lookup table 155*a* according to the present invention is not necessarily limited thereto.

Referring to FIG. 5, the input gray scale voltages Vi_n input to the gray scale voltage selector 155 are 30 first gray scale voltages Vi_0 to Vi_29 in the low gray scale region, and have substantially equal voltage differences therebetween by being divided by the gray scale voltage output unit 153.

The output gray scale voltages Vo_m output from the gray scale voltage selector 155 are 15 second gray scale voltages Vo_1 to Vo_14, and have unequal voltage differences therebetween by selecting 15 of the first gray scale voltages Vi_0 to Vi_29 in the low gray scale region according to the setting of the lookup table 155*a*.

Referring to FIG. 6, the output gray scale voltages Vo_m have non-linear gray scale-voltage characteristics. This means that complex gamma correction in a partial gray scale region (low gray scale region) can be performed to simultaneously correct the voltage-current characteristics of the driving TFT and the OLED panel in the organic light emitting display device.

According to at least one of the disclosed embodiments, voltage-current characteristics of the TFT and OLED panel can be simultaneously corrected by outputting gray scale voltages selected according to a predetermined lookup table. Particularly, gamma correction can be optimized in a low gray scale region.

Further, gray scale voltages can be freely set according to unique characteristics of various types of display panels, thereby improving display quality.

While the above embodiments have been described in connection with the accompanying drawings, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An apparatus for generating a gray scale voltage in an organic light emitting display, the apparatus comprising:

a gamma reference voltage generator configured to output a gamma reference voltage;

a gray scale voltage output unit configured to output N first gray scale voltages, based at least partially on the gamma reference voltage; and a gray scale voltage selector having a lookup table in which voltage values respectively corresponding to M reference gray scales are previously set, wherein the gray scale voltage selector is configured to output second gray scale voltages by selecting M of the N first gray scale voltages, and wherein the gray scale voltage selector is further configured to receive a first set of the first gray scale voltages and to bypass a second set of the first gray scale voltages.

2. The apparatus of claim 1, wherein the gray scale voltage selector is configured to receive at least M of the first gray scale voltages and not to receive the remaining first gray scale voltages.

3. The apparatus of claim 2, wherein the gray scale voltage selector is configured to receive 2M of the first gray scale voltages and not to receive the other (N−2M) first gray scale voltages.

4. The apparatus of claim 2, wherein the first gray scale voltages input to the gray scale voltage selector, the previously set reference gray scales and the second gray scale voltage are ones in a low gray scale region.

5. The apparatus of claim 4, wherein the low gray scale region includes the minimum gray scale voltage among the first gray scale voltages.

6. The apparatus of claim 1, wherein the gamma reference voltage generator is configured to generate a plurality of gamma reference voltages, and wherein the gray scale voltage output unit is configured to generate the first gray scale voltages by dividing voltages between the gamma reference voltages.

7. An apparatus for generating a gray scale voltage in an organic light emitting display, the apparatus comprising:

a gamma reference voltage generator configured to output a gamma reference voltage;

a gray scale voltage output unit configured to output N first gray scale voltages, based at least partially on the gamma reference voltage; and a gray scale voltage selector having a lookup table in which voltage values respectively corresponding to M reference gray scales are previously set, wherein the gray scale voltage selector is configured to output second gray scale voltages by selecting M of the N first gray scale voltages, wherein the gray scale voltage selector is configured to receive at least M of the first gray scale voltages and not to receive the remaining first gray scale voltages, wherein the first gray scale voltages input to the gray scale voltage selector have substantially equal voltage differences therebetween, and wherein the second gray scale voltages have unequal voltage differences therebetween.

8. An apparatus for generating a gray scale voltage in an organic light emitting display, the apparatus comprising:

a gamma reference voltage generator configured to output a gamma reference voltage;

a gray scale voltage output unit configured to output N first gray scale voltages, based at least partially on the gamma reference voltage; and a gray scale voltage selector having a lookup table in which voltage values respectively corresponding to M reference gray scales are previously set, wherein the gray scale voltage selector is configured to output second gray scale voltages by selecting M of the N first gray scale voltages, and wherein the number of the reference gray scales and voltage values corresponding to the respective reference gray scales are varied according to the setting of the lookup table.

9. An apparatus for generating a gray scale voltage in an organic light emitting display, the apparatus comprising:

a gamma reference voltage generator configured to output a gamma reference voltage;

a gray scale voltage output unit configured to output N first gray scale voltages, based at least partially on the gamma reference voltage; and a gray scale voltage selector having a lookup table in which voltage values respectively corresponding to M reference gray scales are previously set, wherein the gray scale voltage selector is configured to output second gray scale voltages by selecting M of the N first gray scale voltages, and wherein N and M are natural numbers, and N is greater than M.

* * * * *